US005586899A

United States Patent [19]

Okada

[11] Patent Number: 5,586,899

[45] Date of Patent: Dec. 24, 1996

[54] ELECTRICAL TERMINAL

[75] Inventor: Naohisa Okada, Yokkaichi, Japan

[73] Assignee: Sumitomo Wiring Systems, Ltd., Japan

[21] Appl. No.: 397,683

[22] Filed: Feb. 28, 1995

[30] Foreign Application Priority Data

Mar. 1, 1994 [JP] Japan ..... 6-056733

[51] Int. Cl.[6] ..... H01R 13/28

[52] U.S. Cl. ..... 439/287

[58] Field of Search ..... 439/286, 290, 439/287, 288, 291, 284, 883

[56] References Cited

U.S. PATENT DOCUMENTS

| | | | |
|---|---|---|---|
| 3,316,522 | 4/1967 | Demler, Sr. | 439/288 |
| 4,273,401 | 6/1981 | Katzin . | |
| 4,357,070 | 11/1982 | Fukishima et al. | 439/287 |
| 4,371,230 | 2/1983 | Inoue . | |

FOREIGN PATENT DOCUMENTS

| | | |
|---|---|---|
| 63-28536 | 3/1988 | Japan . |
| 63-28535 | 8/1988 | Japan . |

*Primary Examiner*—Gary F. Paumen
*Attorney, Agent, or Firm*—Banner & Witcoff, Ltd.

[57] ABSTRACT

Identically shaped electrical terminals are integrated by overlaying one on another. An annular connection region 5 is provided at the head of a barrel region 2, and has an insertion hole 6. On the outer circumference of the connection region 5 are formed symmetrical latch parts 7, 10. An extended region 12 is formed on the base 11, and in which is formed a projection 13 and a lock hole 14 into which the projection 13 of a companion terminal piece 1 can be fitted. Thus, the distance from the centre of the connection region 5 to the projection 13 and the lock hole 14 can be made longer than when forming the projection 13 and the lock hole 14 somewhere in the connection region 5, and thus the angle between the barrel regions 2 when terminal pieces 1 have been overlaid one on another can be reduced.

15 Claims, 3 Drawing Sheets

ELECTRICAL TERMINAL

TECHNICAL FIELD

This invention relates to an electrical terminal adapted to be integrated with other terminals prior to attachment to a connection stud of an apparatus.

BACKGROUND OF THE INVENTION

At present when, for example, the earth wires in a wire harness of an automobile are to be connected to an earth stud or bolt provided on the vehicle body, the attachment operation is performed in a single act by integrating the terminals in advance; this avoids the need to attach the terminals of the wires individually, and thus improves working efficiency.

The terminal disclosed in Laid-Open Japanese Utility Model Sho 63-28536 is such a terminal. With reference to FIGS. 6 and 7 of this specification, a terminal 21 comprises a barrel region 23 secured to the end of an electrical wire 22, and an eye-shaped connection region 25 at the front of the barrel region 23 and having opening in it a through hole 24 for a bolt. Two latch pieces 26 are provided projecting in symmetrical positions on the circumference of the connection region 25. Tongue-shaped latch-receiving parts 27 are formed around the circumferential edge of the connection region 25 rising above the upper surface of the connection region 25 in positions adjacent to the latch pieces 26, to the rear in the counterclockwise direction. Further, projections 28 are formed in the lower surface of the latch-receiving parts 27 by shearing, and lock holes 29 are provided in the latch pieces 26.

In order to integrate two of these identically shaped prior terminals 21, the connection region 25 of one terminal 21 is laid over the upper surface of the connection region 25 of the other terminal 21, concentrically but at a different angle and then, when the upper connecting region 25 is turned in the clockwise direction, its latch pieces 26 engage the companion latch-receiving parts 27 while the projection 28 on the lower terminal 21 fits into the companion lock hole 29 so that the two terminal pieces 21 and 21 are integrated as shown in FIG. 7.

However, the barrel regions of the terminals which have been integrated are splayed apart from each other by a predetermined separation angle θa0, and if this separation angle θa0 is large, an electrical wire has to be substantially bent in order that the two electrical wires are project in the same direction; this puts a substantial load on the bent electrical wire. The smaller the separation angle between the barrel regions, the better the arrangement since the possibility of undue stress or load is reduced, and the wire harness is more compact.

It will be noted that the separation angle θa0 between the barrel regions is determined by the angle θb0 produced by two lines connecting the centre C0 of the connection region with the projection and with the lock hole, and if this angle θb0 is reduced, then the separation angle θa0 between the barrel regions is reduced. In other words, if the distance H0 between the projection and the lock hole is reduced, then the angle θb0 is reduced and the separation angle θa0 can be reduced, but there are limits on reducing the distance H0 between the projection and lock hole because the projection and the lock hole are produced in a press, and they cannot be closer than the minimum separation of the press tool components.

On the other hand, if the connection region is enlarged and the distance from the centre to the projection and the lock hole is increased, then, although the limitation on the distance between the lock hole and the projection is the same, the separation angle θa0 of the barrel regions can be reduced since the angle θb0 between the projection and the lock hole is reduced. However, this has the disadvantage that the connection region is enlarged.

The present invention has taken the above situation into account and aims to provide a terminal which can be integrated by overlaying identically shaped terminals, which does not enlarge the connection region, and which is able to reduce the stress on the electrical wires in the integrated state.

SUMMARY OF THE INVENTION

According to the invention there is provided an electrical terminal having a stud connection region with an aperture therein, a wire connection region for connection to an electrical wire, and a neck region connecting the stud connection region and the wire connection region, the stud connection region having angularly spaced latch members arranged such that overlying terminals are engageable on relative rotation about the aperture to form an integrated terminal, characterised in that the neck region includes angularly spaced male and female lock members engageable on engagement of the latch members.

Such a terminal can be integrated with another identical terminal by relative rotation, but has the advantage that because the projection and lock hole are formed in the neck region, the distance from the centre of the connection region is increased and thus the angle between the wire connection (barrel) regions can be reduced. It follows that the angle through which the wires must be bent to follow a common path is also reduced.

Preferably the neck region extends asymmetrically on one side thereof, and one of the male and female lock members is provided in the extended region. This arrangement has the advantage that the rigidity and strength of the neck region is maintained at a high level.

BRIEF DESCRIPTION OF THE DRAWINGS

Other aspects of the invention will be apparent from the following description of a preferred embodiment shown by way of example only with reference to the accompanying drawings in which.

DESCRIPTION OF THE PREFERRED EMBODIMENT

Figure 1:
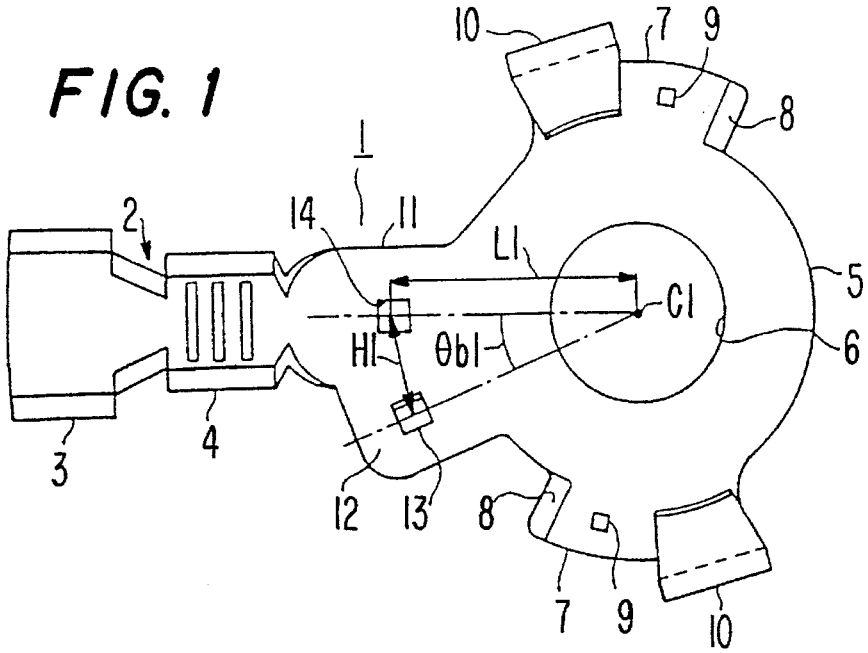
FIG. 1 is a plan view of the terminal according to the present invention.

With reference to the drawings, FIG. 1 illustrates a terminal which has an annular stud connection region 5 at the head of a barrel or wire connection region 2 which comprises an insulation barrel 3 and a wire barrel 4 for respectively clenching the end of the insulation covering of a wire and the core wire projecting from this end. An attachment hole 6 is provided in the centre of the connection region 5 which is fixed over an earthing stud projecting for example from the body of an automobile.

Two wing-shaped latch pieces 7 are provided projecting from the circumference of the connection region 5 in symmetrical positions at points 180° apart. The top surfaces to the front of the latch pieces 7 in the clockwise direction terminate in slopes 8 which gradually thin towards the end. Furthermore, projections 9 are formed in the top surfaces of the latch pieces 7 by punching up.

Figure 4:
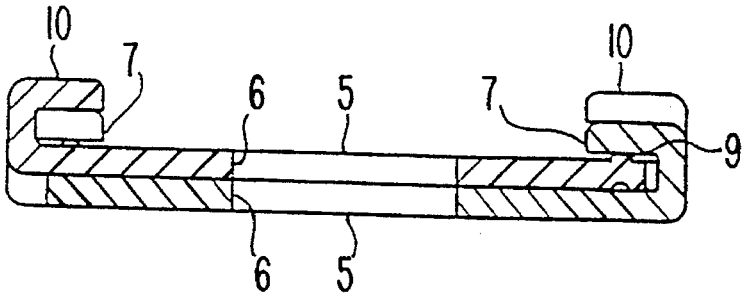
FIG. 4 is a cross section along the line IV—IV in FIG. 3.

Latch-receiving parts 10 into which the latch pieces 7 of the companion terminal 1 can be fitted from the side are formed in positions adjacent to the latch pieces 7 in the anticlockwise direction, this being achieved by extending the circumference of the connection region 5 outwards and folding the extended end upwards and inwards to enclose a predetermined space as illustrated in FIG. 4.

The base 11 of the barrel region 2 defines a neck region, and has its righthand side (as viewed from above in FIG. 1) enlarged to form an extended region 12; a projection 13 is sheared upwardly in a clockwise direction (as viewed) in this extended region 12, roughly in the centre thereof. Formed in the base 11 of the barrel region 2 is a lock hole 14, into which can be engaged the projection of a companion terminal; the lock hole 14 is roughly in the centre of the base 11 at a predetermined dimension clockwise of the projection 13.

The operation of the present embodiment is now described. In order to integrate two terminals with the above-mentioned configuration, firstly, as shown in FIG. 2, the connection region 5 of one terminal 1 is laid over the top surface of the connection region 5 of another terminal 1 with their insertion holes 6 aligned concentrically and turned such that the latch pieces 7 of the upper terminal 1 are positioned counterclockwise to the latch-receiving parts 10 of the lower terminal 1.

Figure 2:
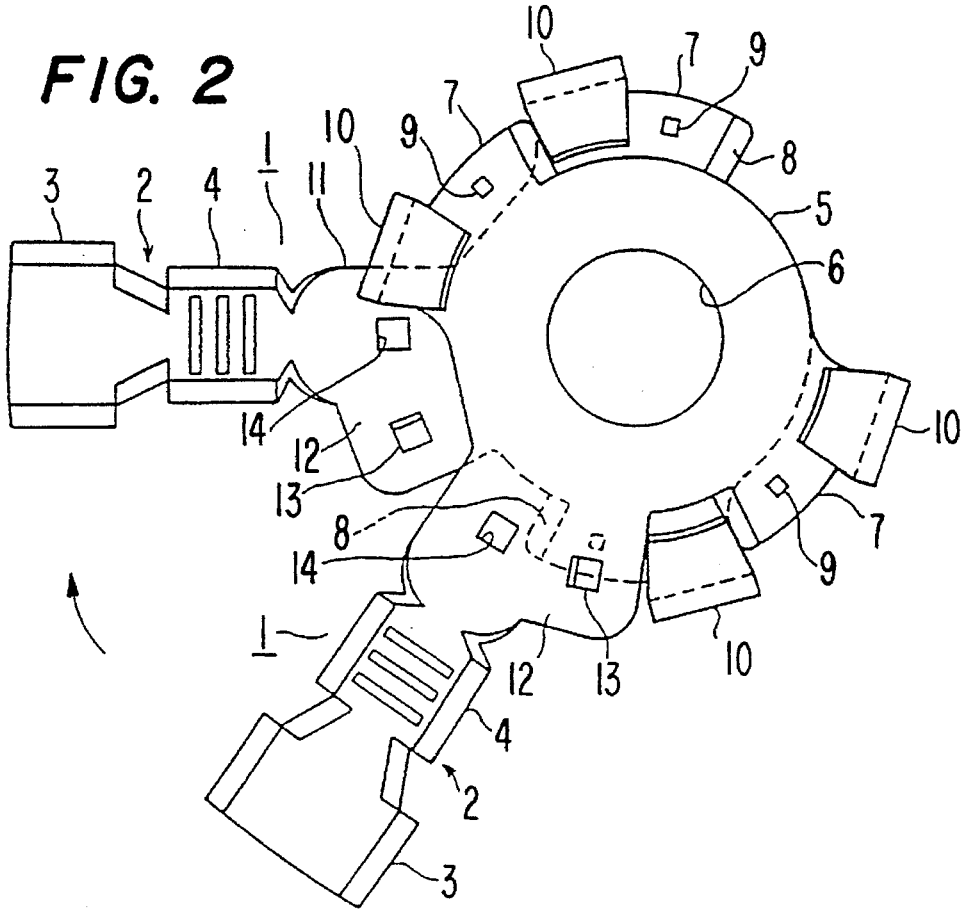
FIG. 2 is a plan view of two terminals overlaid one on another.

Next, the connection region 5 of the upper terminal 1 is turned in the direction of the arrow in FIG. 2 (the clockwise direction), being pressed against the lower connection piece 5 while overcoming the resilient forces to depress the projection 13 formed in the top surface of the lower connection region 5, whereupon the latch pieces 7 of the upper terminal 1 disappear into the latch-receiving parts 10 of the lower terminal 1 to the front (see FIG. 4). At this time, because the top surfaces at the front of the latch pieces 7 in the direction of turning are formed as slopes 8, they engage smoothly into the companion latch-receiving parts 10. Further, because projections 9 are formed in the top surfaces of the latch pieces 7, they are pressed strongly into the latch-receiving parts 10.

Figure 3:
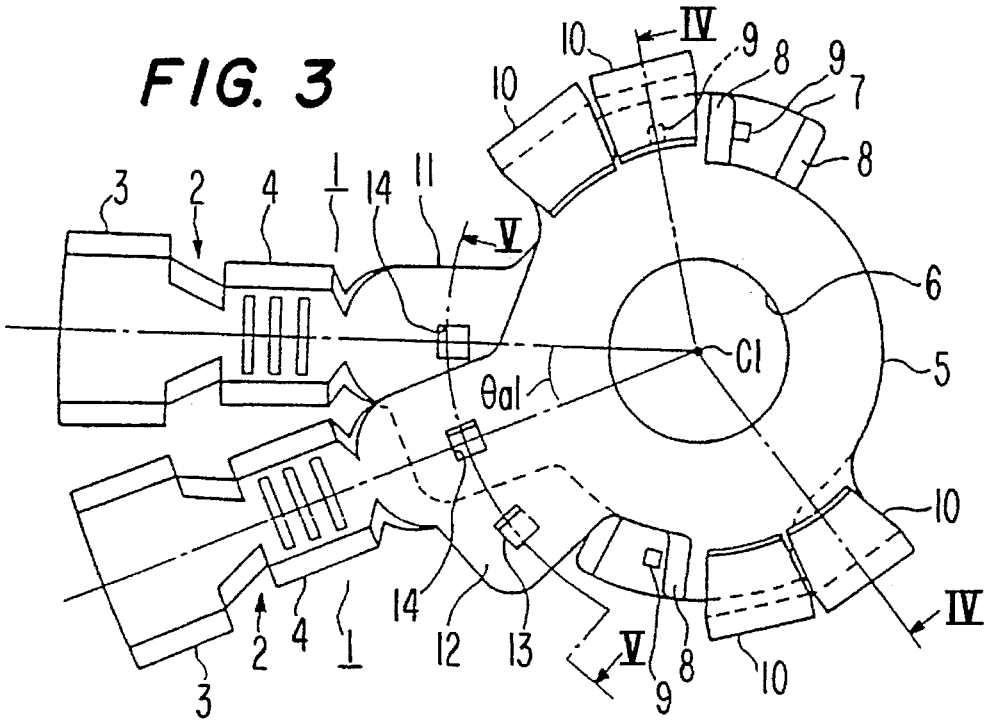
FIG. 3 is a plan view of the two terminals in the integrated state.
Figure 5:
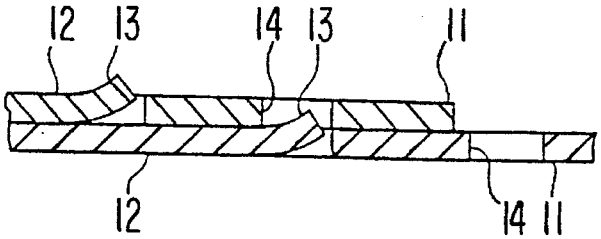
FIG. 5 is a cross section along the line V—V in FIG. 3.
Figure 6:
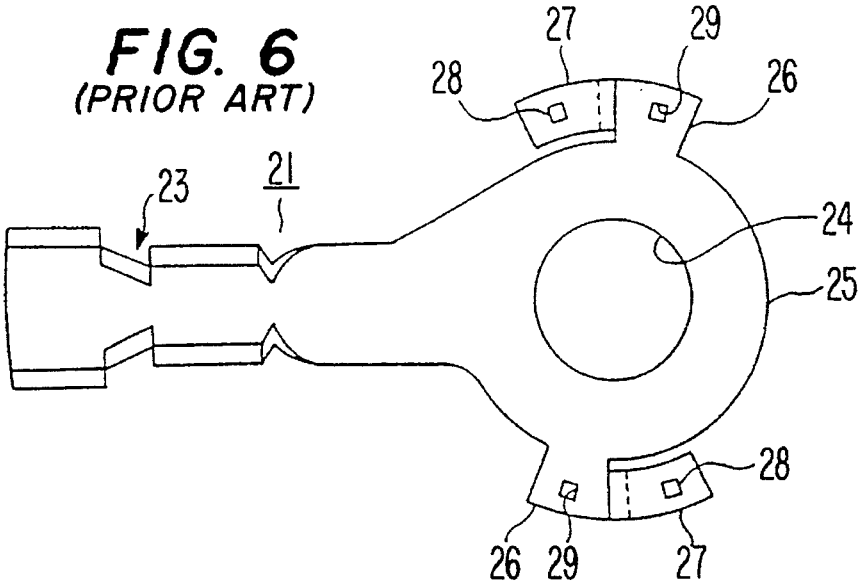
FIG. 6 (PRIOR ART)
FIG. 6 is a plan view of a conventional terminal.
Figure 7:
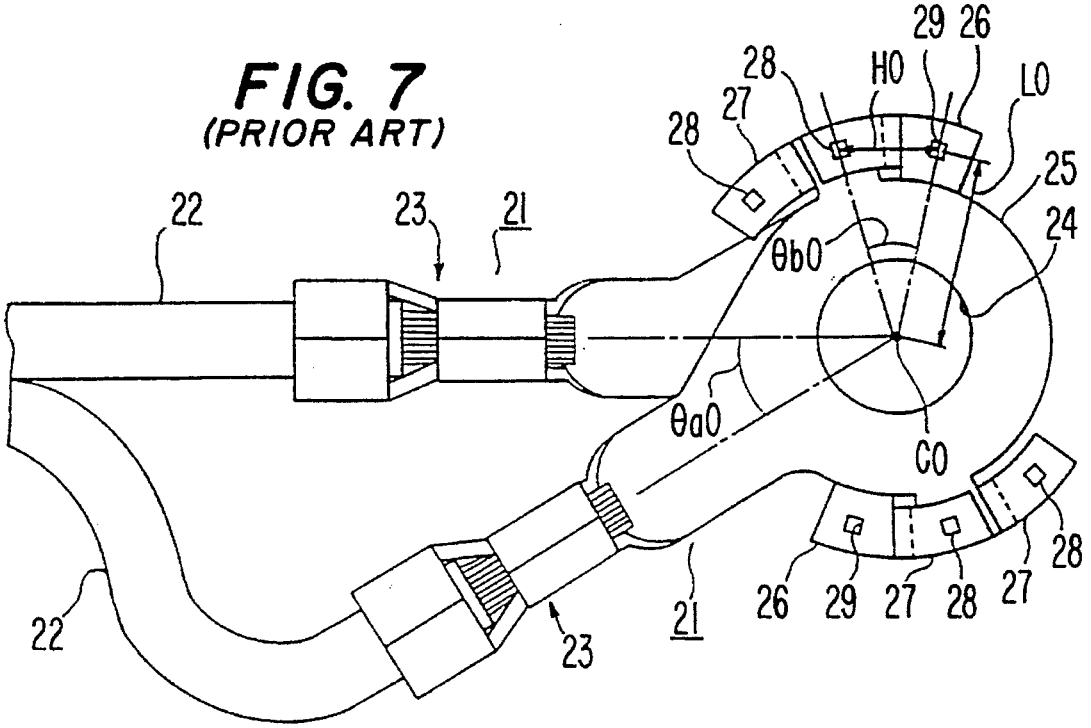
FIG. 7 (PRIOR ART)
FIG. 7 is a plan view of a conventional terminals in the integrated state.

As shown in FIG. 3, the latch pieces 7 disappear into the latch-receiving parts 10 across the whole of their width and are engaged, whereupon the lock hole 14 of the upper terminal 1 corresponds to the position of the projection 13 of the lower terminal 1, and the projection 13 springs up under the resilient restoring force and fits into the lock hole 14 (see FIG. 5).

In this state, the latch pieces 7 of the upper terminal 1 fit into the latch-receiving parts 10 of the lower terminal 1, thereby preventing the connection regions 5 from shifting in the direction in which they would come apart. Further, the upstanding front edge of the projection 13 engages with a side edge of the lock hole 14 of the companion terminal 1, and the front edge of the latch-receiving part 10 of the upper terminal 1 in the clockwise direction latches with the rear edge of the latch-receiving part 10 of the lower terminal 1 in the clockwise direction, thereby preventing turning movements in either direction, and thus the two terminal pieces 1 are integrated.

Here, the barrel regions 2 are separated by a predetermined angle, and this separation angle θa1 (FIG. 3) is the same as the angle θb1 (FIG. 1) produced by the two lines joining the centre C1 of the connection region 5 with the projection 13 and the lock hole 14.

Furthermore, because the projection 13 and the lock hole 14 are formed in the base 11 and the extended region 12 of the barrel region 2, the distance L1 from the centre C1 of the connection region 5 to the projection 13 and the lock hole 14 can be made longer than when forming the projection 13 and the lock hole 14 somewhere in the connection region 5. Thus, if the distance H1 between the projection 13 and the lock hole 14 is a distance limited by press processing, the angle θb1 can be smaller and the opening angle θa1 between the barrel regions 2 smaller than when forming the projection 13 and the lock hole 14 somewhere in the connection region 5.

The two terminal pieces 1 which have been integrated according to the present embodiment in this way are attached and electrically connected to an apparatus by insertion over a stud or bolt which is provided projecting in the connection region of the apparatus, and by screwing a nut onto the end of the stud or bolt, and tightening. In other words, the attachment operation is completed in one operation.

Furthermore, because the projection 13 and lock hole 14 are formed in positions most distant from the centre of the connection region 5, the separation angle between the barrel regions 2 can be minimised and the stress on the electrical wire can be reduced.

The number of terminals which can be integrated by overlaying is not limited to two in number. In the case of more than two terminals, the angle between the barrel regions 2 positioned on the outside does become greater as the number of overlaid terminal pieces 1 increases. The separating angle between neighbouring barrel regions 2 can be reduced by the above-mentioned arrangement, and thus there is the pronounced advantage that the angle through which the barrel regions 2 extend as the number of overlaid terminal pieces increases is considerably less than hitherto, and the stress on the electrical wires is reduced compared to what has been the case previously.

Furthermore, because an extended region 12 is formed in the base 11, the rigidity of the base 11 is high and its strength is maintained despite the formation of the lock hole 14.

It should be noted that the present invention is not limited to the embodiment described above and, by way of example, modifications can be made as described below, and these embodiments are also included in the technical scope of the present invention.

In the described embodiment, the projection 13 is formed by shearing up, but the projection may also be formed by raising the upper surface of the extending region 12.

In the described embodiment, the projection 13 is formed in the extended region 12, and a lock hole 14 is formed in the base 11 of the barrel region 2, but the reverse case can also be employed with the lock hole being formed in the extended region and the projection being formed in the base.

Other arrangements are also possible.

I claim:

1. An electrical terminal having a stud connection region with an aperture therein, a wire connection region for connection to an electrical wire, and a neck region connecting the stud connection region and the wire connection region, the stud connection region having angularly spaced latch members arranged such that said electrical terminal is engageable with an identical, overlying electrical terminal upon relative rotation of said electrical terminals about said aperture to form an integrated terminal assembly, wherein said neck region includes angularly spaced male and female lock members in a generally planar surface, one of which is engageable with the other one of a male and female lock member of the overlying electrical terminal to prevent decoupling of the electrical terminals on engagement of said latch members.

2. A terminal according to claim 1 wherein said wire connection region has a longitudinal axis and said neck region has an extended region extending asymmetrically to one side of said axis.

3. A terminal according to claim 2 wherein one of said male and female lock members lies on said longitudinal axis.

4. A terminal according to claim 3 wherein said female lock member lies on said axis.

5. A terminal according to claim 3 wherein said male lock member is resilient.

6. A terminal according to claim 1 and having one female lock member and one male lock member.

7. A terminal according to claim 6 wherein said wire connection region has a longitudinal axis and one of said lock members lies on said axis.

8. A terminal according to claim 7 wherein a female lock member lies on said axis.

9. A terminal according to claim 1 wherein said female lock member comprises an aperture.

10. A terminal according to claim 9 wherein said male lock member comprises an upstanding projection.

11. A terminal according to claim 10 wherein the free end of said tag faces towards said aperture.

12. A terminal according to claim 11 wherein said male lock member is resilient.

13. A terminal according to claim 1 and formed from sheet metal.

14. An electrical terminal having a stud connection region with an aperture therein, a wire connection region for connection to an electrical wire, and a neck region connecting the stud connection region and the wire connection region, the stud connection region having angularly spaced latch members arranged such that said electrical terminal is engageable with an identical, overlying electrical terminal upon relative rotation of said electrical terminals about said aperture to form an integrated terminal assembly, wherein said neck region includes angularly spaced male and female lock members one of which is engageable with the other one of a male and female lock member of the overlying electrical terminal to prevent decoupling of the electrical terminals on engagement of said latch members, wherein said lock members are spaced radially from said aperture a distance at least substantially equal to an outer edge of at least one of said latch members.

15. A terminal according to claim 14 wherein the male and female lock members are formed in a generally planar surface of said neck region.

* * * * *